US006102726A

United States Patent [19]

Tsuji et al.

[11] Patent Number: 6,102,726

[45] Date of Patent: Aug. 15, 2000

[54] CONNECTOR FITTING STRUCTURE

[75] Inventors: Masanori Tsuji; Toru Nagano, both of Shizuoka, Japan

[73] Assignee: Yazaki Corporation, Tokyo, Japan

[21] Appl. No.: 09/322,160

[22] Filed: May 28, 1999

[30] Foreign Application Priority Data

May 28, 1998 [JP] Japan ..... 10-147779

[51] Int. Cl.[7] ..... H01R 13/627

[52] U.S. Cl. ..... 439/352; 439/489

[58] Field of Search ..... 439/352, 353, 439/354, 357, 489

[56] References Cited

U.S. PATENT DOCUMENTS 4,993,967 2/1991 Matsumoto ..... 439/489
5,370,543 12/1994 Hamada et al. ..... 439/188

FOREIGN PATENT DOCUMENTS 9-134757 5/1997 Japan ..... H01R 13/639

*Primary Examiner*—Khiem Nguyen
*Attorney, Agent, or Firm*—Sughrue, Mion, Zinn, Macpeak & Seas, PLLC

[57] ABSTRACT

The connector fitting structure includes: a first connector 2 including in the leading end portion thereof a pair of engaging grooves 7 and a pair of securing projections; and, a second connector 3 including a housing main body 4 which incorporates therein not only a pair of flexible lock arms 10 each having in the leading end thereof a lock portion 9 to be engaged with its associated one of the two engaging grooves 7 but also a slider 5 elastically energized in the axial direction thereof and including in the front end portion thereof a pair of contact portions 11 to be engaged with their associated securing projections 8. The slider 5 is mounted within the housing main body 4 in such a manner that it sits astride the lock arms 10 and it can be slided not only in the back-and-forth direction but also in the vertical direction; and, in the lock arms 10, there are provided the push-up projections 14 which are used to push up the contact portions 11.

5 Claims, 10 Drawing Sheets

CONNECTOR FITTING STRUCTURE

BACKGROUND OF THE INVENTION

1. Field of the Invention

The present invention relates to a connector fitting structure of a direct connection type which is used to connect various kinds of electronic equipment and electric wires directly to each other and, in particular, to a connector fitting structure which is able to prevent an incomplete fit between two connectors and secure a positive fit lock between them.

2. Description of the Related Art

Conventionally, as a connector fitting structure, for example, there is known such a connector fitting structure as is disclosed in Japanese Patent Unexamined Publication No. 9-134757 of Heisei.

As shown in FIG. 11, a related connector fitting structure 61 includes a first connector 62 which is mainly mounted on electric equipment in an integral manner, and a second connector 63 on which an electric wire with a connector terminal pressed against the end portion thereof is mainly mounted. The second connector 63 is structured with a housing main body 64, and a slider 65 which can be slided on the outer periphery of the housing main body 64 in the axial direction thereof and is also elastically energized forward by a spring member (not shown).

On the other hand, the first connector 62 includes a housing 66 and, in the leading end portion of the housing 66, there are formed a pair of engaging grooves 67 and a pair of securing projections 68. And, in the leading end portion of the housing main body 64 of the second connector 63, there are disposed a pair of flexible lock arms 70 each of which includes a lock portion 69 engageable with its associated one of the engaging grooves 67 of the housing 66 of the first connector 62.

Also, in the slider 65, there are formed a contact portion 71 which is elastically energized forward in the axial direction of the slider 65 so as to control the flexure of the lock arms 70 and also the front end portion of which can be contacted with the securing projections 68 of the housing 66 of the first connector 62. The contact portion 71 is formed in the front end portion of a cantilever arm 72, while the cantilever arm 72 is formed in the rear end portion of the slider 65, can be flexed outwardly, and each includes a rectangular-shaped slide hole 73 in the central portion thereof.

Further, at the position of the housing main body 64 that correspond to the slide hole 73, there are provided a cantilever arm push-up projection 74.

As shown in FIG. 12, in the above-structured connector fitting structure 61, if the first and second connectors 62 and 63 are fitted with each other, at first, the contact portion 71 formed in the leading end portion of the cantilever arm 72 disposed on the slider 65 is contacted with the securing projection 68 provided on the housing 66 of the first connector 62. And, if the housing main body 64 of the second connector 63 is pushed further in the fitting direction, then only the housing main body 64 is allowed to move forward in the fitting direction while the slider 65 remains stopped.

As a result, as shown in FIG. 13, the respective front half section of the lock arm 70 is exposed from the slider 65 and is thus easy to flex upward. Then, if the housing main body 64 is pushed in still further, then the lock portions 69 are moved forward while they run up onto the front end portion of its mating partner, that is, the housing 66 of the first connector 62.

As shown in FIG. 14, just before the lock portion 69 is locked into their associated engaging groove 67, the cantilever arm push-up projection 74 push up its associated contact portion 71 to thereby remove the securing thereof by the securing projection 68. As a result of this, the lock portion 69 is locked into their associated engaging groove 67 and, at the same time, the slider 65 is moved forward due to the elastic energization force thereof to cover the thus locked lock portion 69, thereby preventing the lock portion 69 against removal.

By the way, to remove the mutual fit between the first and second connectors 62 and 63, if the slider 65 is pulled back in the opposite direction to the fitting direction, then the housing main body 64 is also pulled back because the slider 65 includes a movement restrict mechanism (not shown) formed between the housing main body 64 and itself. At the then time, because the lock portion 69 is not covered by the slider 65 and also because the lock portion 69 also includes an inclined surface in the rear surface thereof, the lock arm 70 is flexed outwardly and is thereby removed from the engagement with its associated engaging groove 67. As a result of this, the first and second connectors 62 and 63 can be removed from each other.

However, in the above-mentioned conventional connector fitting structure 61, as shown in FIG. 13, the lock mechanism thereof, in particular, the lock portion 69, lock arm 70 and engaging groove 67 are respectively disposed on the upper side of FIG. 13. On the other hand, the detect mechanism thereof, in particular, the securing projection 68, contact portion 71 and cantilever arm push-up projection 74 are respectively disposed on the lower side of FIG. 13. Therefore, when the first and second connectors 62 and 63 are fitted with each other in such a manner that they are inclined excessively, the lock and detect mechanisms of the connector fitting structure can be shifted in timing from each other and the fitting operation of the first and second connectors 62 and 63 can be thereby interrupted on its way, which can result in an incomplete fit between the first and second connectors 62 and 63.

That is, when the contact portion 71 is removed from the securing projections 68 and the slider 65 is thereby moved forward due to the elastic energization force thereof, unless the lock portion 69 is locked into the engaging groove 67, then the slider 65 moves up onto the lock arms 70.

Also, when fitting the first and second connectors 62 and 63 with each other, only the housing main body 64 is pushed in. However, since the housing main body 64 is disposed inside the slider 65, it is rather difficult to operate the housing main body 64. Also, when removing the mutual fit between the first and second connectors 62 and 63, only the slider 65 is pulled back. However, this makes it easy to cause a wrong operation.

SUMMARY OF THE INVENTION

The present invention aims at eliminating the drawbacks found in the above-mentioned conventional connector fitting structure. Accordingly, it is an object of the invention to provide a connector fitting structure which can prevent an incomplete fit between two connectors even if they are fitted with each other while they are inclined, is easy to operate, and can provide an excellent operation efficiency.

In attaining the above object, according to the invention, there is provided a connector fitting structure, including: a first connector including an engaging groove and a securing projection formed in a leading end portion of a housing thereof; and, a second connector including: a housing main body having a flexible lock arm, a slider mounted in the housing main body so as to be slidable not only in the back-and-forth direction but also in the vertical direction, and an elastic member elastically energizing the slider with respect to the housing main body in the back-and-forth direction. The slider includes a contact portion contactable with said securing projection, which is provided in a front end portion thereof. The lock arm includes: a lock portion engageable with the engaging groove, which is provided in a leading end portion thereof; and a push-up projection for pusing up the contact portion.

Further, according to another aspect, there is provided a connector fitting structure, including: a first connector including an engaging groove and a securing projection formed in a leading end portion of a housing thereof; and, a second connector including: a housing main body having a flexible lock arm, a slider mounted in the housing main body so as to be slidable in the back-and-forth direction, and an elastic member elastically energizing the slider with respect to the housing main body in the back-and-forth direction. The slider includes a pair of flexible cantilever arms projecting forwardly, which are respectively provided in a lateral direction. The cantilever arms has a pair of contact portions contactable with said securing projection, which are respectively provided in a front and inner face thereof. The contact portion has a removing inclined surface on the back surface thereof. The lock arm includes: a lock portion engageable with the engaging groove, which is provided in a leading end portion thereof; and a pair of removing projections respectively provided in outer faces of respective center portions thereof, for spreading open the pair of cantilever arms in the lateral direction to thereby remove the locking of the slider by the contact portions.

DETAILED DESCRIPTION OF THE PREFERRED EMBODIMENTS

[First Embodiment]

Figure 1:
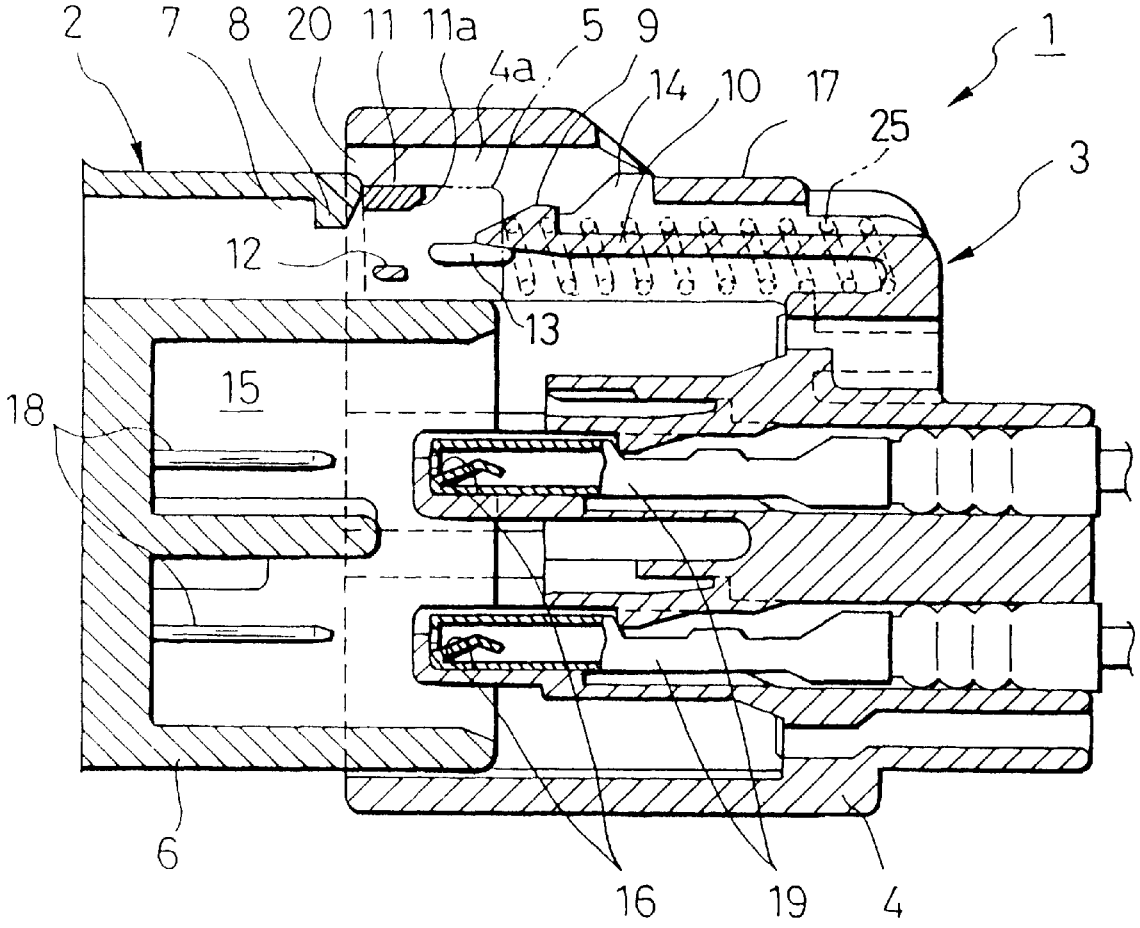
FIG. 1 is a longitudinal section view of a first embodiment of a connector fitting structure according to the invention, showing a state thereof at the time when fitting starts.

Now, description will be given below in detail of a first embodiment of a connector fitting structure according to the invention with reference to FIGS. 1 to 5.

As shown in FIGS. 1 to 5, a connector fitting structure 1 according to the first embodiment of the invention is composed of a first connector 2 which is mainly mounted on electric equipment or the like in an integral manner, and a second connector 3 on which an electric wire with a connector terminal pressed against the end portion thereof can be mainly mounted. The second connector 3 includes a housing main body 4, and a slider 5 which not only can be slided back and forth as well as up and down within a slider storage portion 4*a* of the housing main body 4, but also is elastically energized in the forward direction by a compression spring 25.

In the leading end portion of the housing 6 of the first connector 2, there are formed a pair of engaging grooves 7 and a pair of securing projections 8; and, on the leading end portion of the housing main body 4 of the second connector 3, there is provided a pair of flexible lock arms 10 including a pair of lock portions 9 which can be engaged with the engaging grooves 7.

Figure 2:
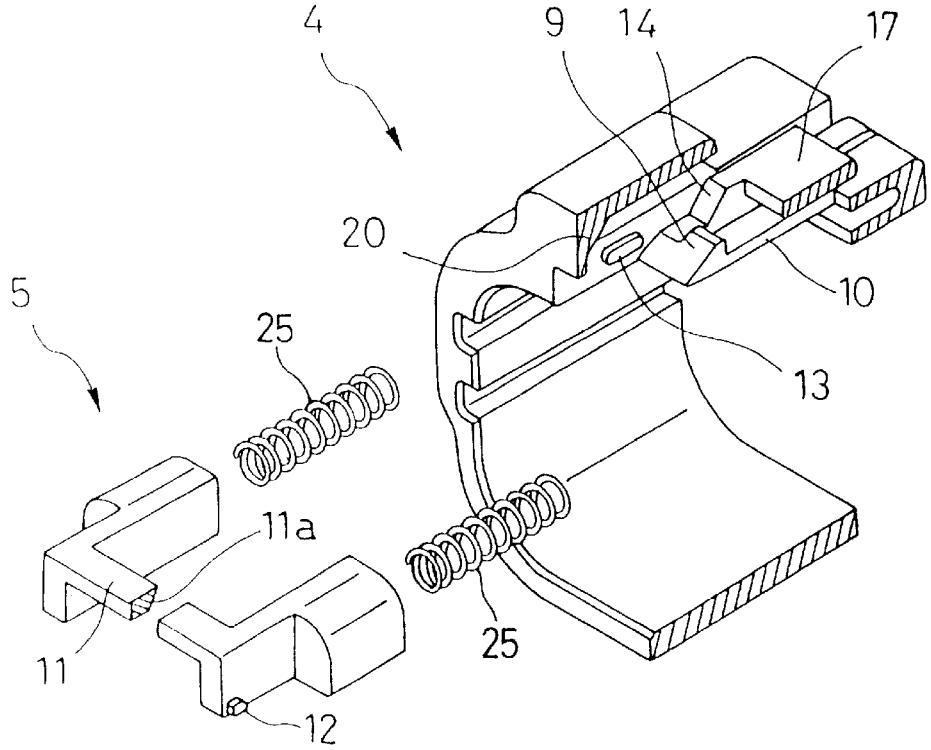
FIG. 2 is an exploded perspective view of a housing main body and a slider respectively shown in FIG. 1.

Also, as shown in FIG. 2, in the slider 5, in particular, in the front end portion thereof, there are formed a contact portions 11 which can be contacted with the securing projection 8 in order to stop temporarily the forward movement of the slider 5. The contact portions 11 are respectively mounted on the upper portion of the front end of the slider 5 and each of the contact portions 11 includes an inclined surface 11*a* in the rear surface thereof.

Also, on the front end lower portions of the right and left side surfaces of the slider 5, there are projectingly provided a pair of guide projections 12. The pair of guide projections 12 are structured such that they can be moved along the peripheries of a pair of guide rails 13 respectively provided on and projected from the right and left inner surfaces of the slider storage portion 4*a* to thereby assist the movement of the slider 5.

Further, at the positions on the lock arms 10 in the rear of the lock portions 9 that respectively correspond to the two contact portions 11, there are provided a pair of push-up projections 14 which are used to push up the slider 5.

Also, into the inner space 15 of the housing 6 of the first connector 2, there are projected connector terminals 18 of a male type and, within the terminal storage chambers 16 of the housing main body 4, there are mounted connector terminals 19 of a female type.

By the way, on the rear end portion of each of the push-up projections 14, there is mounted a pressure plate 17 which is used to flex its associated lock arm 10 downward and, on the respective inner walls of the front end upper portion of the housing main body 4, there are projectingly provided a pair of stopper projections 20 which are respectively used to stop their associated contact portions 11.

In the above-structured connector fitting structure 1, if the first and second connectors 2 and 3 are fitted with each other as shown in FIG. 1, then the leading end faces of the contact portions 11 formed in the slider 5 are firstly contacted with their respective securing projections 8 provided on the housing 6 of the first connector 2 to thereby stop temporarily the forward movement of the slider 5. Further, if the housing main body 4 of the second connector 3 is pushed in the fitting direction, then only the housing main body 4 is allowed to move forward in the fitting direction while the slider 5 remains stopped.

Figure 3:
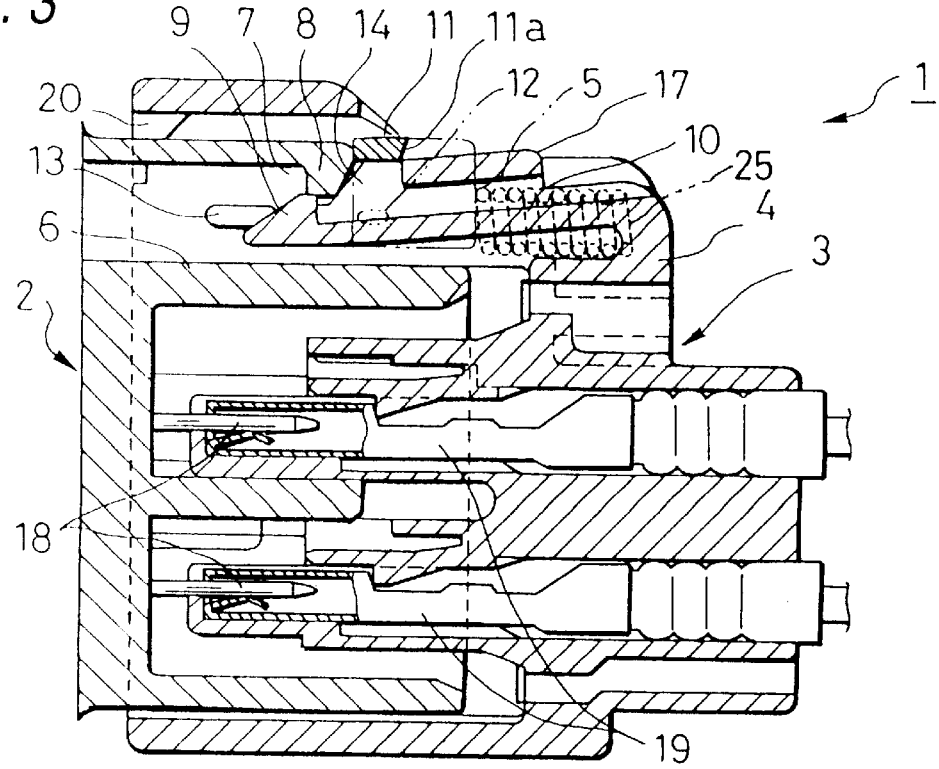
FIG. 3 is an explanatory view of the operation of the first embodiment shown in FIG. 1, showing a fitting intermediate state thereof.

Then, as shown in FIG. 3, the inclined surfaces of the leading end portions of the securing projections 8 are respectively contacted with their associated inclined surfaces of the leading end portions of the lock portions 9 to thereby push down the lock portions 9, so that the lock arms 10 are flexed downward. And, the lock portions 9 move forward in such a manner that they pass through the front end of the mating housing 6. In this operation, because the push-up projections 14 are respectively contacted with the inclined surfaces 11*a* of the contact portions 11, while the slider 5 is opposed against the elastic energization force of the compression spring 25, the slider 5 is pushed upward while sliding on the front end faces of the securing projections 8.

Figure 4:
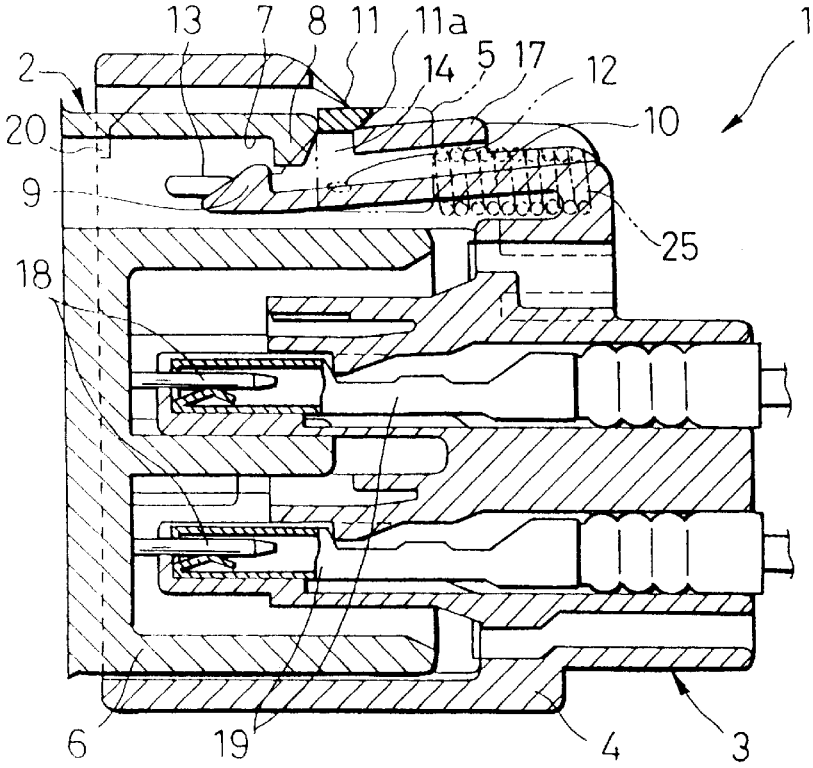
FIG. 4 is an explanatory view of the operation of the first embodiment shown in FIG. 1, showing a further advanced state from the fitting intermediate state shown in FIG. 3.
Figure 5:
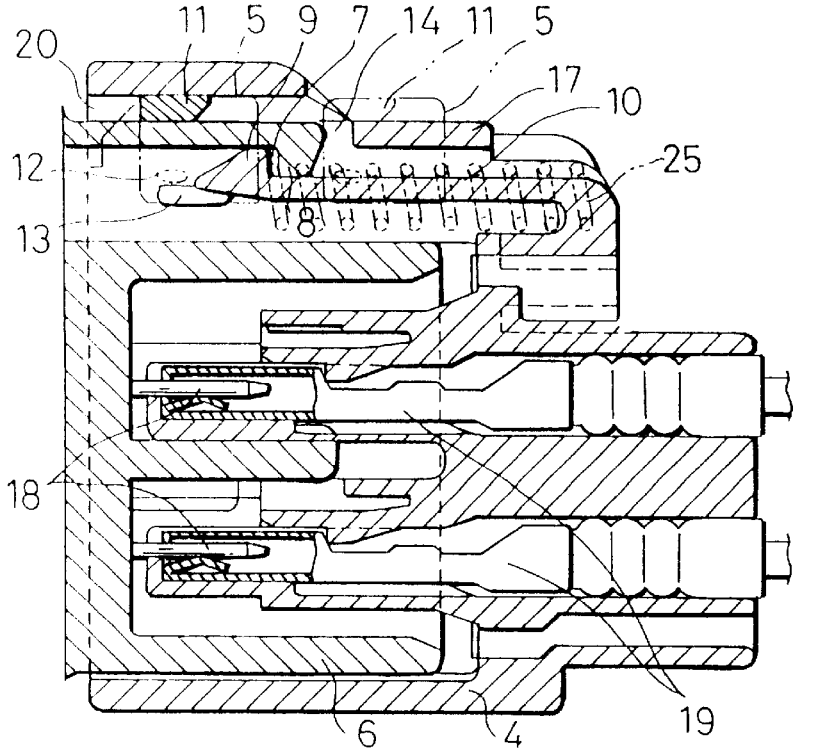
FIG. 5 is an explanatory view of the operation of the first embodiment shown in FIG. 1, showing a completed state in the fitting operation shown in FIG. 4.

After then, as shown in FIG. 4, just before the lock portions 9 are locked by the engaging grooves 7, the push-up projections 14 push up the contact portions 11 further. And, as shown in FIG. 5, the lock portions 9 are locked by the engaging grooves 7 and, at the same time, the slider 5 is allowed to move forward due to the elastic energization force of the compression spring 25 until it is contacted with the stopper projections 20 provided on the front end portion of the housing main body 4. This completes the fitting operation between the first and second connectors 2 and 3; that is, not only the two connectors 2 and 3 can be locked together in a complete fit condition, but also the male-type and female-type connector terminals 18 and 19 of the two connectors 2 and 3 are connected together electrically.

Also, when removing the fit between the first and second connectors 2 and 3, if the pressure plate 17 are pressed down to thereby flex the lock arms 10 downward, then the lock portions 9 can be removed from their respective engaging grooves 7 and, after then, if the housing main body 4 is pulled in the opposite direction to the fitting direction, then the two connectors 2 and 3 can be removed from each other.

As has been described above, in the connector fitting structure 1 according to the first embodiment of the invention, the slider 5 is mounted within the housing main body 4 in such a manner that it sits astride the lock arms 10 and it can be slided not only in the back-and-forth direction but also in the vertical direction; and, in each of the lock arms 10, there is provided the push-up projection 14 which is used to push up its associated one of the contact portion 11.

Thanks to this structure, not only the engaging grooves 7, securing projections 8, lock portions 9 and lock arms 10 respectively serving as a securing mechanism, but also the contact portions 11 and push-up projections 14 respectively serving as a detect mechanism are located near on the same line of the first and second connectors 2 and 3. Therefore, even if the two connectors 2 and 3 are fitted together in an inclined manner, there is no possibility that the operation timings of the securing and detect mechanisms can be shifted from each other to thereby leave the two connectors 2 and 3 in an incomplete fit condition.

And, when the two connectors 2 and 3 are fitted together completely, the slider 5 is completely stored within the housing main body 4, which makes it possible to detect the state of the connector assembly even through visual observation. Also, since the slider 5 is stored within the housing main body 4, the fitting and removing operations can be all carried out through the movement of the housing main body 4, which not only facilitates the operation of the connector fitting structure but also eliminates a fear of a wrong operation. That is, according to the first embodiment of the invention, there can be supplied a connector fitting structure which is highly reliable and can provide an excellent operation efficiency.

[Second Embodiment]

Next, description will be given below in detail of a second embodiment of a connector fitting structure according to the invention with reference to FIGS. 6 to 10.

As shown in FIGS. 6 to 10, a connector fitting structure 31 according to the second embodiment of the invention is composed of a first connector 32 which is mainly mounted on electric equipment or the like in an integral manner, and a second connector 33 on which an electric wire with a connector terminal pressed against the end portion thereof can be mainly mounted. The second connector 33 includes a housing main body 34, and a slider 35 which not only can be slided back and forth as well as up and down within the housing main body 34, but also is elastically energized in the forward direction by a compression spring 55.

In the leading end portion of the housing 36 of the first connector 32, there are formed a pair of engaging grooves 37 and a pair of securing projections 38; and, on the leading end portion of the housing main body 34 of the second connector 33, there are provided a pair of flexible lock arms 40 each including a lock portion 39 which can be engaged with its associated one of the engaging grooves 37.

Also, the slider 35 is mounted within the housing main body 34 in such a manner that not only it sits astride the lock arms 40 but also it can be slided back and forth; and, on the right and left portions of the slider 35, there are provided a pair of flexible cantilever arms 43 and 43 in such a manner that they respectively project forward.

Further, in the front end upper portions of the respective inner walls of the two cantilever arms 43, there are formed a pair of contact portions 41 and 41 each having a removing inclined surface 42 on the back surface thereof; and, in the lower portions of the central portions of the two cantilever arms 43, there are formed a pair of flexure preventive portions 44 and 44 which are used to control the flexure of the lock arms 40.

Figure 7:
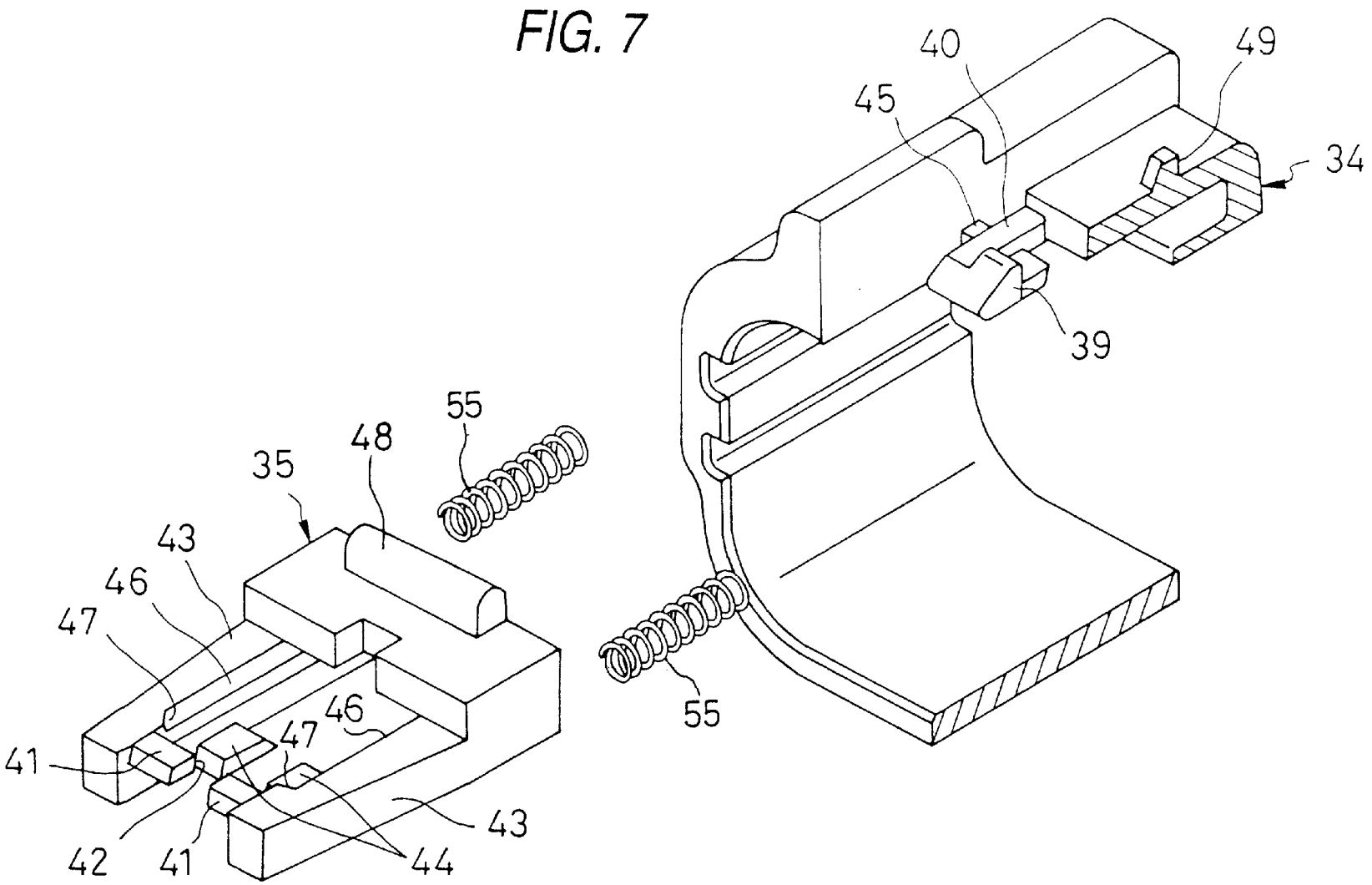
FIG. 7 is an exploded perspective view of a housing main body and a slider respectively shown in FIG. 6.

Also, as shown in FIG. 7, on the outer surfaces of the respective central portions of the lock arms 40, there are provided a pair of removing projections 45 and 45 which are used to spread open the pair of cantilever arms 43 and 43 in the right and left directions to thereby remove the locking of the slider 35 by the contact portions 41; and, in the respective inner walls of the cantilever arms 43 and 43, there are formed a pair of groove portions 46 along which the removing projections 45 are allowed to move, and a pair of removing inclined surfaces 47.

Further, on the upper surface of the rear end of the slider 35, there is provided a knob portion 48 which is used to remove the fit between the first and second connectors 32 and 33; and, on each of the lock arms 40, there is provided a stopper projection 49 which is used to restrict the movement of the slider 35 with respect to the housing main body 34. By the way, the housing 36 of the first connector 32 includes an internal space 50 into which male-type connector terminals 51 are projected; and, the housing main body 34 of the second connector 33 includes a pair of terminal storage chambers 52 in which female-type connector terminals 53 are respectively mounted.

Figure 6:
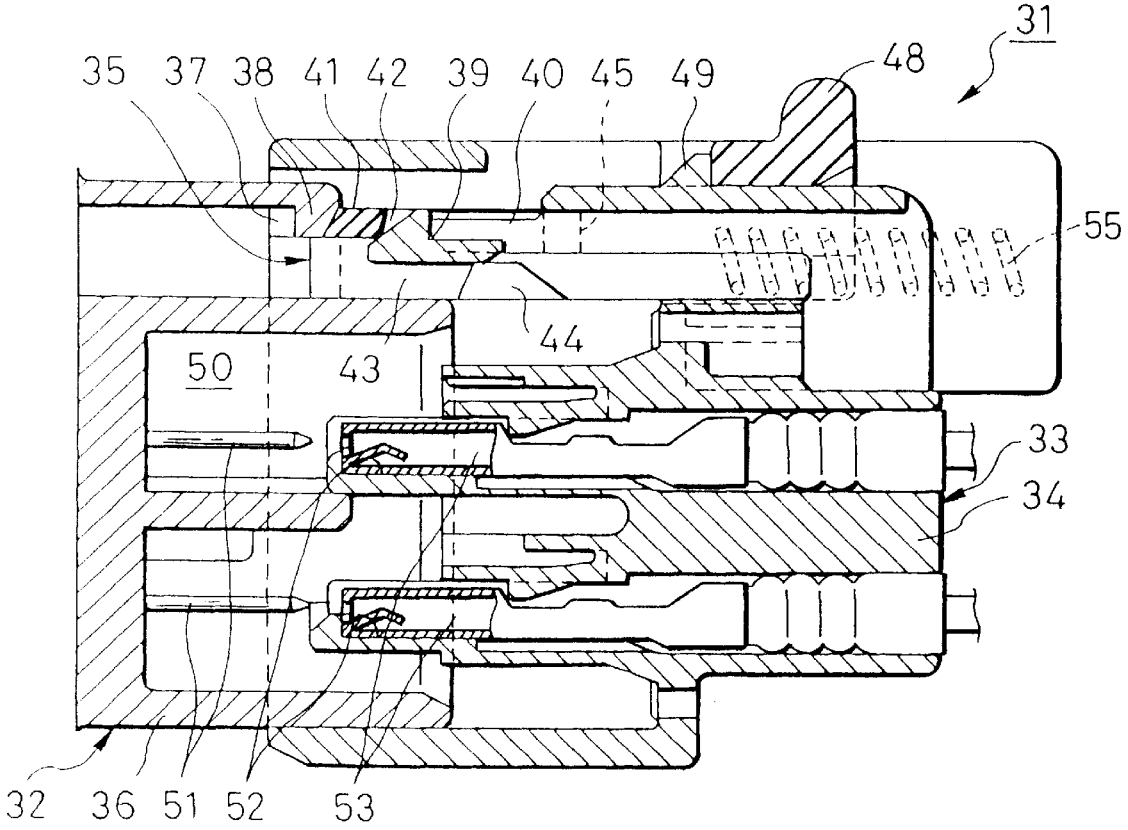
FIG. 6 is a longitudinal section view of a second embodiment of a connector fitting structure according to the invention, showing a state thereof at the time when fitting starts.
Figure 8:
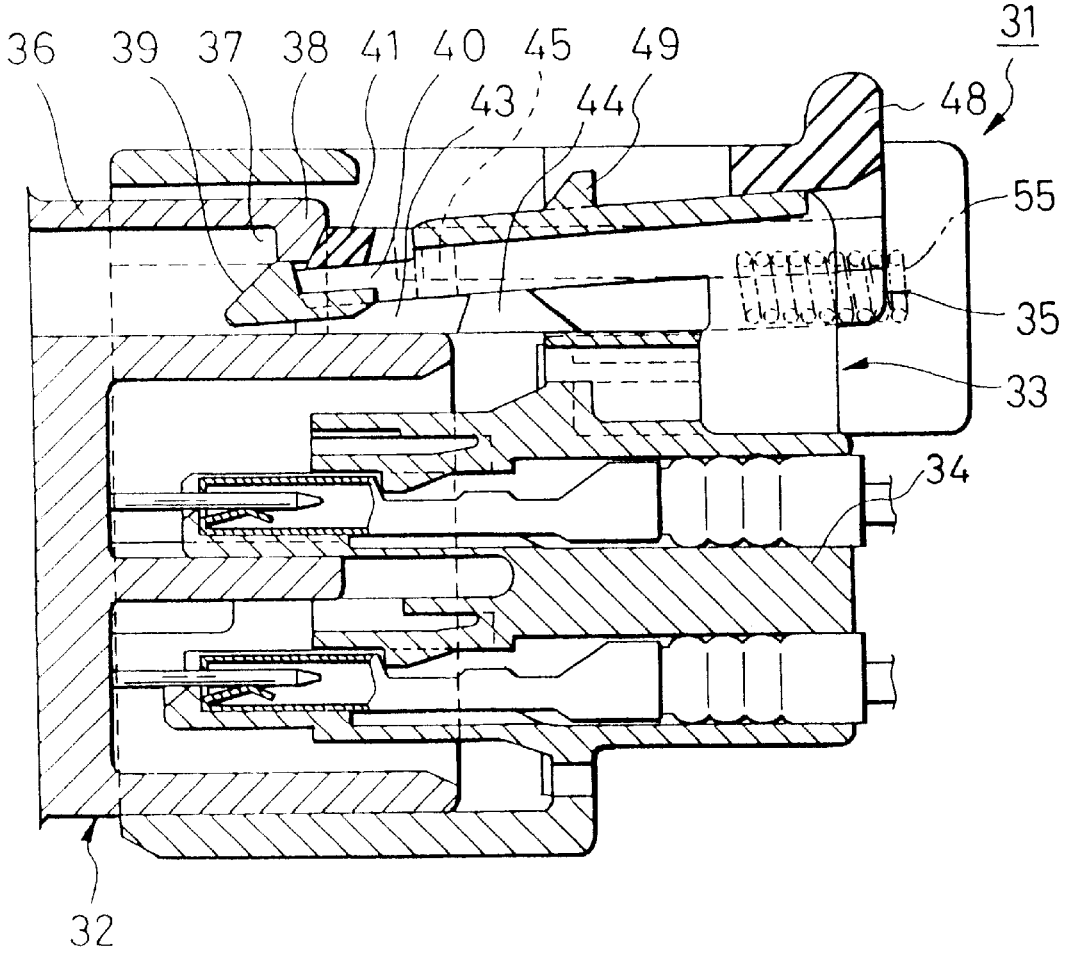
FIG. 8 is an explanatory view of the operation of the second embodiment shown in FIG. 6, showing a fitting intermediate state thereof.

In the above-structured connector fitting structure 31, as shown in FIG. 6, if the first and second connectors 32 and 33 are fitted with each other, then the respective leading end faces of the two contact portion 41 formed in the slider 35 are firstly contacted with the securing projection 38 of the first connector 32. And, if the housing main body 34 of the second connector 33 is pushed in the fitting direction, then only the housing main body 34 is allowed to move forward in the fitting direction while the slider 35 remains stopped. Accordingly, as shown in FIG. 8, the inclined surfaces of the leading end portions of the securing projections 38 are respectively contacted with the inclined surfaces of the leading end portions of the lock portions 39 to thereby push down the lock portions 39, so that the lock arms 40 are flexed downward. Thus, the lock portions 39 are allowed to move forward in such a manner that they pass below the front end of the mating housing 36.

Figure 9:
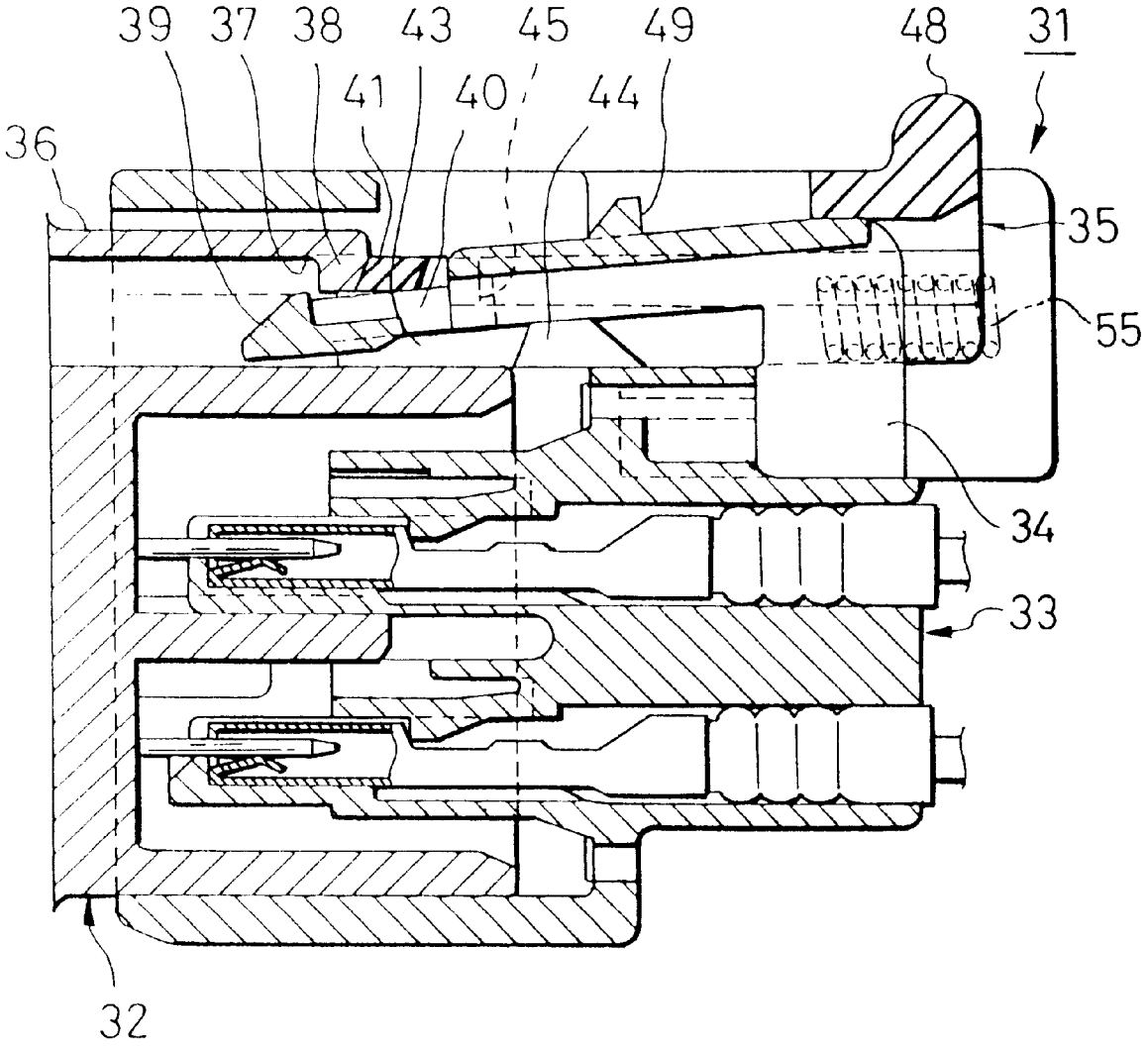
FIG. 9 is an explanatory view of the operation of the second embodiment shown in FIG. 6, showing a further advanced state from the fitting intermediate state shown in FIG. 8.
Figure 10:
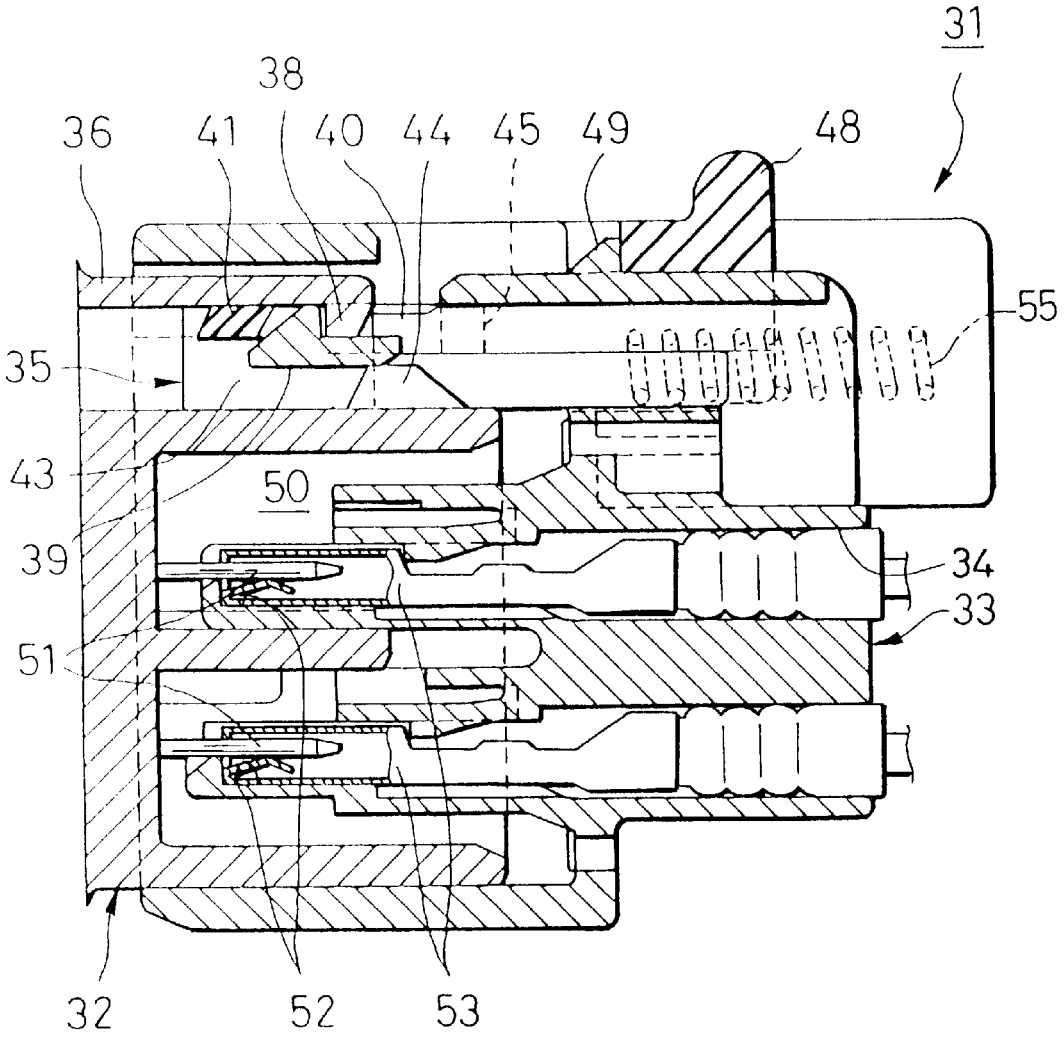
FIG. 10 is an explanatory view of the operation of the second embodiment shown in FIG. 6, showing a completed state in the fitting operation shown in FIG. 9.
Figure 11:
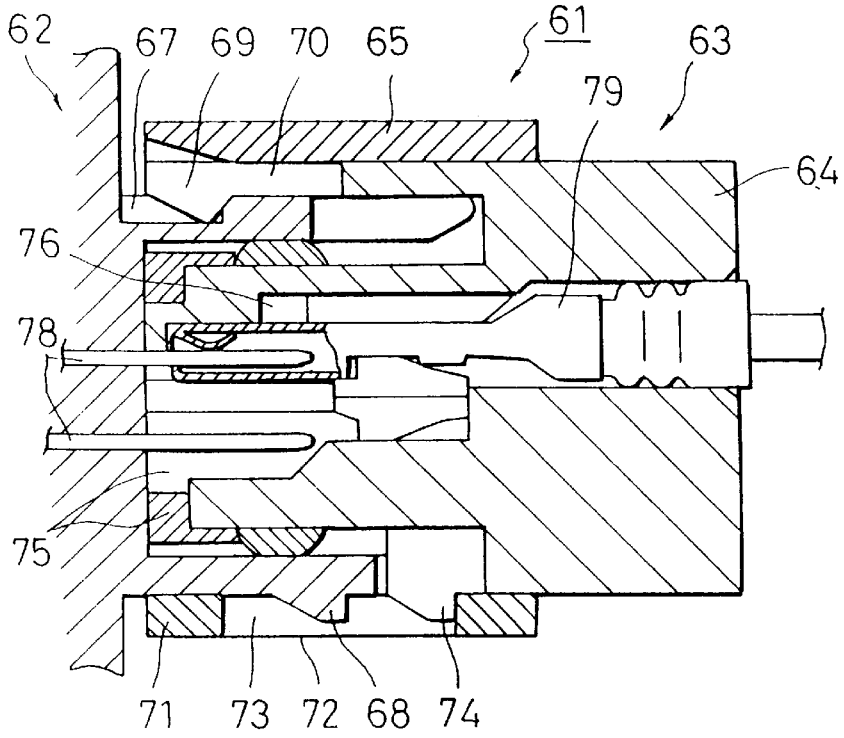
FIG. 11 PRIOR ART
FIG. 11 is a longitudinal section view of an example of a related connector fitting structure.
Figure 12:
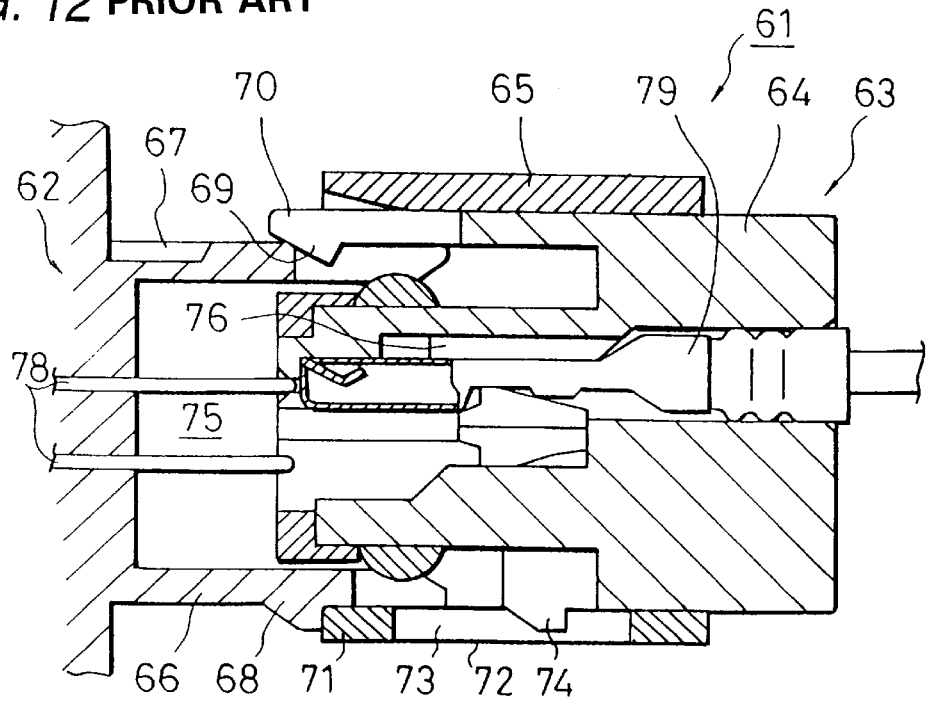
FIG. 12 PRIOR ART
FIG. 12 is a longitudinal section view of the related connector fitting structure shown in FIG. 11, showing a state thereof at the time when fitting starts.
Figure 13:
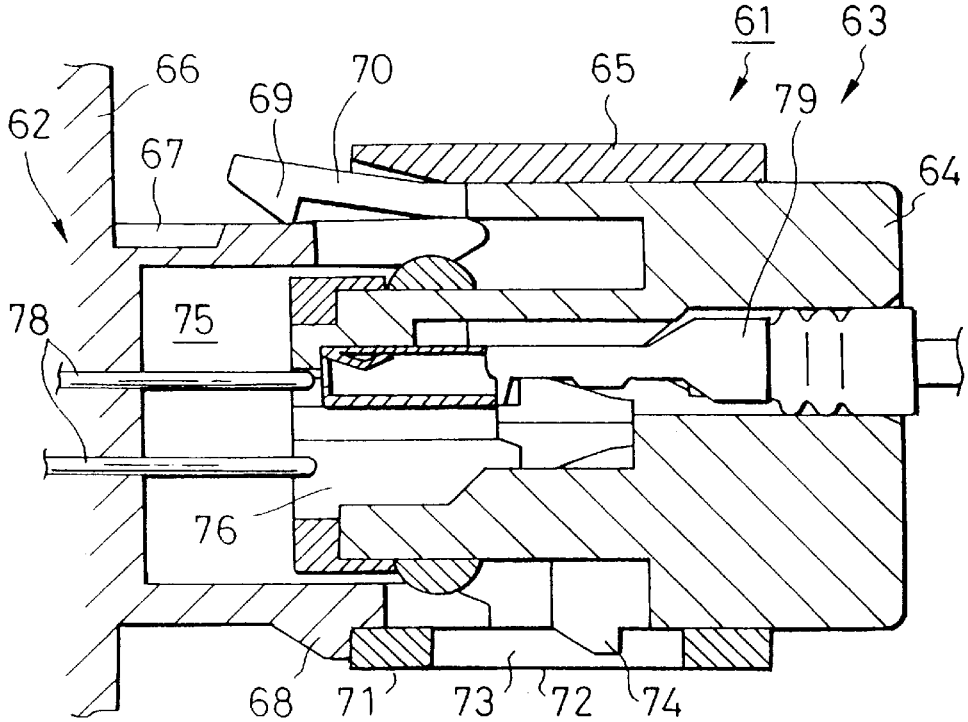
FIG. 13 PRIOR ART
FIG. 13 is an explanatory view of the operation of the related connector fitting structure shown in FIG. 11, showing a fitting intermediate state thereof; and, FIG. 14 is an explanatory view of the operation of the conventional connector fitting structure shown in FIG. 11, showing a further advanced state from the fitting intermediate state shown in FIG. 13.
Figure 14:
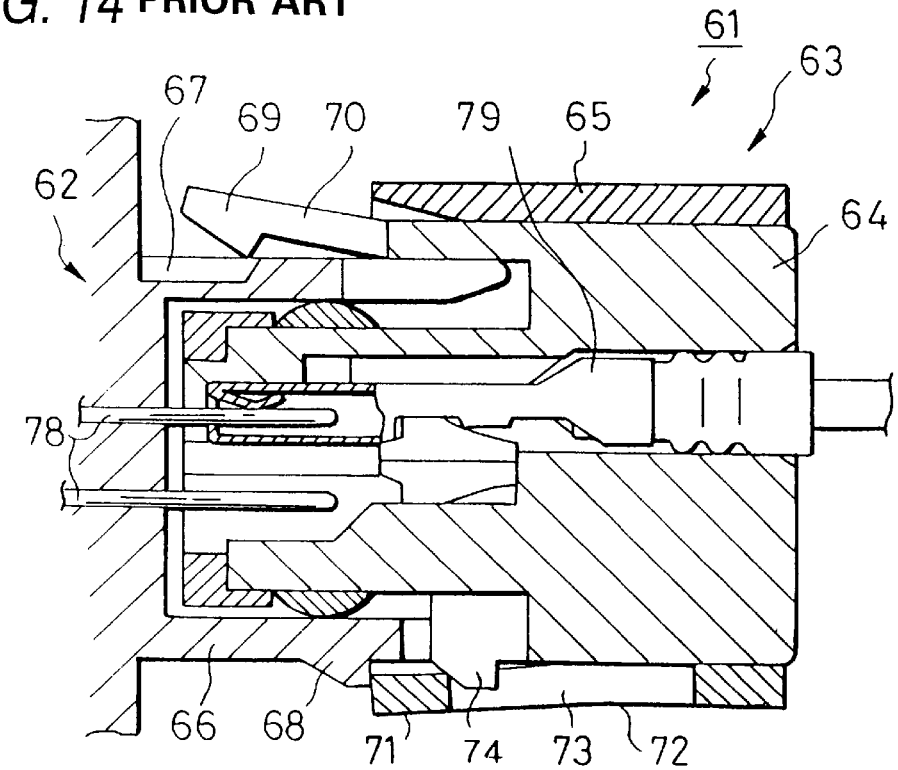
FIG. 14 PRIOR ART

In this operation, as shown in FIGS. 7 and 9, because the removing projections 45 are contacted with their associated removing inclined surfaces 47 provided in the front ends of the groove portions 46, the pair of cantilever arms 43 and 43 of the slider 35 are pushed and opened right and left respectively, so that, as shown in FIG. 10, the contact portions 41 in contact with the securing projections 38 are opened right and left respectively. As a result of this, the slider 35 is allowed to move in the direction of the front end portion of the housing main body 34 due to the elastic energization force of the compression spring 55 and, at the same time, the lock portions 39 can be locked into their associated engaging grooves 37 respectively. And, since the two flexure preventive portions 44 hold the leading end portions of the lock arms 40 from the bottoms thereof to thereby prevent them from being flexed, thereby eliminating the possibility that the locking of the lock arms 40 can be removed. This completes the fitting operation between the first and second connectors 32 and 33.

Next, when removing the fit between the first and second connectors 32 and 33, if the knob portion 48 of the slider 35 is pulled in the opposite direction to the fitting direction, while opposing against the elastic energization force of the compression spring 55, then the flexure preventive portions 44 are removed from the lower portions of the leading ends of their respective lock arms 40. In this operation, the removing inclined surfaces 42 of the contact portions 41 press down the lock portions 39 to thereby remove the locking of the lock portions 39 by the engaging grooves 37. That is, due to the removal of the locking as well as due to the elastic energization force of the compression spring 55, the housing main body 34 can also be pulled out easily from the housing 36.

As described above, in the connector fitting structure 31 according to the second embodiment, the slider 35 is mounted within the housing main body 34 in such a manner that it sits astride the lock arms 40 and it can be slided back and forth. Also, the slider 35 includes in the right and left portion thereof the pair of cantilever arms 43 and 43 in such a manner that they project forward. Further, in the front end upper portions of the respective inner walls of the two cantilever arms 43, there are formed the pair of contact portions 41 and 41 each having a removing inclined surface 42 on the back surface thereof; and, in the lower portions of the central portions of the two cantilever arms 43, there are formed the pair of flexure preventive portions 44 and 44 which are used to control the flexure of the lock arms 40. Still further, on the outer surfaces of the central portions of the lock arms 40, there are provided the pair of removing projections 45 and 45 which are used to spread open the pair of cantilever arms 43 and 43 in the right and left direction respectively to thereby remove the locking of the slider 35 by the contact portions 41.

Thanks to this structure, not only the lock arms 40, lock portions 39, securing projections 38 and engaging grooves 37 respectively serving as a securing mechanism, but also the contact portions 41, flexure preventive portions 44 and removing projections 45 respectively serving as a detect mechanism are located near on the same line of the first and second connectors 32 and 33. Therefore, even if the two connectors 32 and 33 are fitted together in an inclined manner, there is no possibility that the operation timings of the securing and detect mechanisms can be shifted from each other to thereby leave the two connectors 32 and 33 in an incomplete fit condition.

Also, the position of the slider 35 with respect to the housing main body 34 makes it possible to detect the complete fit condition through visual observation. Further, the fitting operation is carried out by pushing and moving only the housing main body 34, while the fit removing operation is executed by pulling out only the slider 35, so that both of the fitting and removing operations can be performed with ease.

Still further, since the slider 35 is simply moved back and forth within the housing main body 34, the smooth elastic energization of the slider 35 can be expected. Therefore, according to the second embodiment of the invention, there can be supplied a connector fitting structure which is high in reliability and can provide an excellent operation efficiency.

By the way, the connector fitting structure of the invention is not limited to the above-mentioned first and second embodiments, but the invention can also be enforced in other embodiments by changing the first and second embodiments in a proper manner. For example, although there are provided a pair of lock arms 10, 40 and a pair of lock portions 9, 39 in the two illustrated embodiments, there may be provided a single lock arm and a single lock portion in the central portion of the housing main body 4, 34, provided that the shapes of their locking partners, that is, securing projections 8, 38 and engaging grooves 7, 37 are so modified as to correspond to the single lock arm and the single lock portion.

As has been described heretofore, according to one aspect of the connector fitting structure of the invention, the slider is mounted within the housing main body in such a manner that it sits astride the lock arms and it can be slided not only in the back-and-forth direction but also in the vertical direction; and, in each of the lock arms, there is provided the push-up projection which is used to push up its associated one of the two contact portions.

Thanks to this structure, not only the lock arms, lock portions, securing projections and engaging grooves respectively serving as a securing mechanism, but also the contact portions and push-up projections respectively serving as a detect mechanism are located near on the same line of the first and second connectors. Therefore, even if the two connectors are fitted together in an inclined manner, there is no possibility that the operation timings of the securing and detect mechanisms can be shifted from each other to thereby leave the two connectors in an incomplete fit condition.

Also, since the slider is stored within the housing main body, the fitting and removing operations can be all carried out through the movement of the housing main body, the operations necessary for fitting and removing the two connectors can be all carried out easily and positively. Therefore, according to the invention, there can be supplied a connector fitting structure which is highly reliable and can provide an excellent operation efficiency.

Also, according to another aspect of the connector fitting structure of the invention, the slider is mounted in the housing main body in such a manner that it sits astride the lock arms and it can be slided back and forth. Also, the slider includes in the right and left portion thereof the pair of cantilever arms in such a manner that they project forward. Further, in the front end upper portions of the respective inner walls of the two cantilever arms, there are formed the pair of contact portions each having a removing inclined surface on the back surface thereof; and, in the lower portions of the central portions of the two cantilever arms, there are formed the pair of flexure preventive portions which are used to control the flexure of the lock arms. Still further, on the outer surfaces of the central portions of the lock arms, there are provided the pair of removing projections which are used to spread open the pair of cantilever arms in the right and left directions respectively to thereby remove the locking of the slider by the contact portions.

Thanks to this structure, not only the lock arms, lock portions, securing projections and engaging grooves respectively serving as a securing mechanism, but also the contact portions, flexure preventive portions and removing projections respectively serving as a detect mechanism are located near on the same line of the first and second connectors. Therefore, even if the two connectors are fitted together in an inclined manner, there is no possibility that the operation timings of the securing and detect mechanisms can be shifted from each other to thereby leave the two connectors in an incomplete fit condition.

Also, since the fitting operation can be carried out simply by pushing and moving the housing main body in the fitting direction and the fit removing operation can be executed simply by the pulling out the slider in the opposite direction to the fitting direction, the operations necessary for fitting and removing the two connectors can be performed easily with no fear of wrong operation. Further, because the slider is simply moved in the axial direction thereof within the housing main body, the smooth elastic energization of the slider can be surely expected. Thus, according to the invention, there can be supplied a connector fitting structure which is higher in reliability and can provide an excellent operation efficiency.

The present disclosure relates to the subject matter contained in Japanese patent application No. Hei. 10-147779 filed on May 28, 1998 which is expressly incorporated herein by reference in its entirety.

What is claimed is:

1. A connector fitting structure, comprising:

a first connector including an engaging groove and a securing projection formed in a leading end portion of a housing thereof; and, a second connector including: a housing main body having a flexible lock arm, a slider mounted in said housing main body so as to be slidable not only in the back-and-forth direction but also in the vertical direction, and an elastic member elastically energizing said slider with respect to said housing main body in the back-and-forth direction, said slider including a contact portion contactable with said securing projection, which is provided in a front end portion thereof, said lock arm including: a lock portion engageable with said engaging groove, which is provided in a leading end portion thereof; and a push-up projection for pusing up said contact portion.

2. A connector fitting structure according to claim 1, wherein said slider is mounted within said housing main body in such a manner that said slider sits astride said lock arms.

3. A connector fitting structure, comprising:

a first connector including an engaging groove and a securing projection formed in a leading end portion of a housing thereof; and, a second connector including: a housing main body having a flexible lock arm, a slider mounted in said housing main body so as to be slidable in the back-and-forth direction, and an elastic member elastically energizing said slider with respect to said housing main body in the back-and-forth direction, said slider including a pair of flexible cantilever arms projecting forwardly, which are respectively provided in a lateral direction, said cantilever arms having a pair of contact portions contactable with said securing projection, which are respectively provided in the front and inner faces thereof, said contact portion having a removing inclined surface on the back surface thereof, said lock arm including: a lock portion engageable with said engaging groove, which is provided in a leading end portion thereof; and a pair of removing projections respectively provided in outer faces of respective center portions thereof, for spreading open said pair of cantilever arms in the lateral direction to thereby remove the locking of said slider by said contact portions.

4. A connector fitting structure according to claim 3, wherein said slider is mounted within said housing main body in such a manner that said slider sits astride said lock arms.

5. A connector fitting structure according to claim 3, wherein said cantilever arms further include a pair of flexure preventive portions respectively provided in the lower faces of the center portions thereof, for controlling the flexure of said lock arm.

* * * * *